United States Patent [19]

Niedermeyer

[11] 4,079,776

[45] Mar. 21, 1978

[54] MOLD MAKING MACHINE

[75] Inventor: William S. Niedermeyer, Eastlake, Ohio

[73] Assignee: Acme-Cleveland Corporation, Cleveland, Ohio

[21] Appl. No.: 679,579

[22] Filed: Apr. 23, 1976

[51] Int. Cl.[2] ..... B22D 17/32

[52] U.S. Cl. ..... 164/154

[58] Field of Search ..... 164/154, 4, 12, 16

[56] References Cited

U.S. PATENT DOCUMENTS

| | | | |
|---|---|---|---|
| 3,556,195 | 1/1971 | Lund | 164/16 |
| 3,587,709 | 6/1971 | Miller et al. | 164/12 |
| 3,888,293 | 6/1975 | Laforet et al. | 164/16 |

*Primary Examiner*—Richard B. Lazarus

*Attorney, Agent, or Firm*—Woodling, Krost, Granger & Rust

[57] ABSTRACT

A conversion unit is disclosed for converting a mold forming machine from a dry mold material forming process to a moist mold material mold forming process, to form a mold item. The conversion unit comprises mold material injection means having an aperture for injecting the mold material therefrom. The mold material injection means is moved adjacent an aperture in a moldbox of the mold forming machine to inject the mold material into a cavity of the moldbox. The mold material injection means is retracted from the moldbox enabling an aperture sealing means to be rotated between the apertures of the moldbox and the mold material injection means. The mold material injection means is again advanced toward the moldbox to seal the aperture of the moldbox by the aperture sealing means enabling a gas for curing the mold material to enter the mold cavity by gas ports internal the moldbox means. The invention may include an adjustable mounting for the mold material injection means enabling adjustment in accordance with the size of the moldbox of the mold forming machine. The foregoing abstract is merely a resume of one general application, is not a complete discussion of all principles of operation or applications, and is not to be construed as a limitation on the scope of the claimed subject matter.

10 Claims, 5 Drawing Figures

MOLD MAKING MACHINE

BACKGROUND OF THE INVENTION

1. Field of the Invention

This invention relates to mold forming machines and more particularly to mold forming machines and conversion units for converting a mold forming machine from a dry mold material forming process to a moist mold material forming process by which mold items may be formed from a curable mold material.

2. Description of the Prior Art

The prior art has known various types of dry mold material mold forming machines and moist material mold forming machines for forming a mold item or a core item in a foundry process. The term mold item is used herein to include both molds and cores as conventionally used in the trade. In the dry mold material mold forming processes a moldbox having a mold cavity was heated by gas flame or electric heating. A dry mold material with a thermosetting binder was injected into the mold cavity to form the mold item. This hot mold forming process could be used to form a shell mold or core whereas the moist mold material mold forming process was generally restricted to form a solid mold or core. The dry mold material was generally easier to use than the moist mold material since the thermosetting binder on the dry mold material did not become sticky until reaching an elevated temperature.

The moist mold material mold forming processes generally used a gas or heat curable mold material having a sticky gas or heat curable binder and a sand type of material making this combination more difficult to work with than the thermosetting mold material. After the gas curable mold material was injected into the moldbox cavity, a catalytic gas was introduced into the mold cavity for several seconds and then purged from the mold cavity so that the mold item could be removed from the moldbox.

In the past many hot mold forming processes were used to manufacture various types of mold and core item. However, since the cost of energy and natural gas has substantially increased in the past several years, many of the hot mold forming processes are now more expensive than comparable cold mold forming processes. Many machines are now in use in foundries all over the world which were specifically designed for a hot mold forming process.

Therefore, it is an object of this invention to provide a conversion unit for converting a mold forming machine from a dry mold material mold forming process to a moist mold material mold forming process which unit can be easily adapted to the many existing hot mold forming machines.

Another object of this invention is to provide a conversion unit for converting a mold forming machine from a dry mold material mold forming process to a moist mold material mold forming process incorporating aperture sealing means which is rotatably mounted relative to a mold material injection means for sealing an aperture in the moldbox prior to introduction of a curing gas.

Another object of this invention is to provide a conversion unit for converting a mold forming machine from a dry mold material mold forming process to a moist mold material mold forming process having adjustable conversion unit support means for adjustably mounting the mold material injection means relative to the mold forming machine in accordance with the size of the moldbox of the mold forming machine.

Another object of this invention is to provide a conversion unit for converting a mold forming machine from a dry mold material mold forming process to a moist mold material mold forming process including first means for linearly advancing the mold material injection means adjacent the moldbox of the mold forming machine to enable injection of the mold material into aperture means of the moldbox and for retracting the mold material injection means from the moldbox after injection of the mold material enabling second movement means to rotate aperture sealing means adjacent the aperture means of the moldbox to be linearly advanced by the first movement means to seal the aperture means of the moldbox.

Another object of this invention is to provide a conversion unit for converting a mold forming machine from a dry mold material mold forming process to a moist mold material mold forming process including control means and mold material curing means including gas injection means for injecting a curing gas within the mold cavity upon sealing of the mold cavity.

Another object of this invention is to provide a conversion unit for converting a mold forming machine from a dry mold material mold forming process to a moist mold material mold forming process by which the mold making process may be performed at a substantial saving of energy.

SUMMARY OF THE INVENTION

The invention may be incorporated into a conversion unit for converting a mold forming machine from a dry mold material mold forming process to a moist mold material mold forming process by which a mold item may be formed from a curable material, the mold forming machine having moldbox means defining a mold cavity with aperture means in communication with the mold cavity, comprising in combination, mold material injection means having aperture means for injecting mold material from said aperture means, aperture sealing means rotatably mounted relative to said aperture means of said mold material injection means, first movement means for causing relative movement between said mold material injection means and the moldbox means of the mold forming machine, second movement means for rotating said aperture sealing means relative to said aperture means of the moldbox means, control means, means connecting said control means to said first movement means for establishing said mold material injection means to be adjacent the moldbox means enabling injection of the mold material through said aperture means into the mold cavity, means connecting said control means to said second movement means for rotating said aperture sealing means to seal said aperture means of the moldbox means, mold material curing means connectable to the moldbox means of the mold forming machine, and means connecting said control means to said mold material curing means for enabling cure of the mold material to form the mold item.

Other objects and a fuller understanding of the invention may be had by referring to the following description and claims, taken in conjunction with the accompanying drawings.

DESCRIPTION OF THE PREFERRED EMBODIMENT

Figure 1:
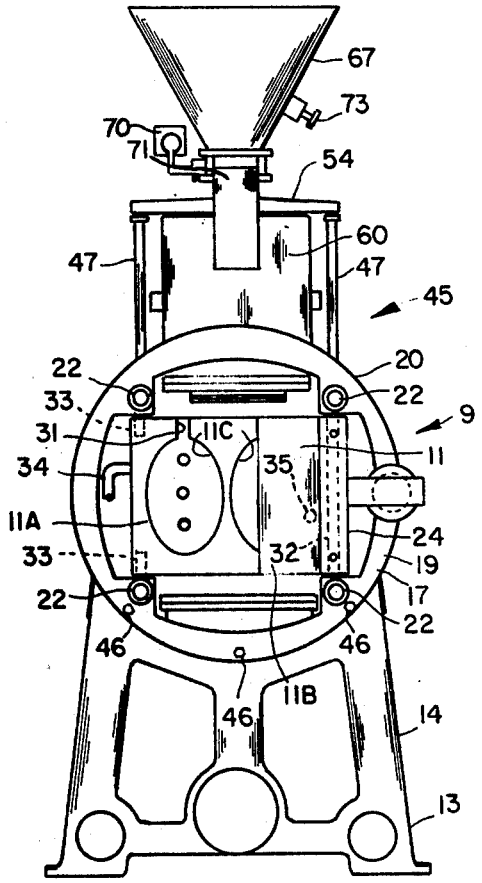
FIG. 1 is a front view of a mold forming machine incorporating the conversion unit with the moldbox open illustrating the mold cavity.
Figure 2:
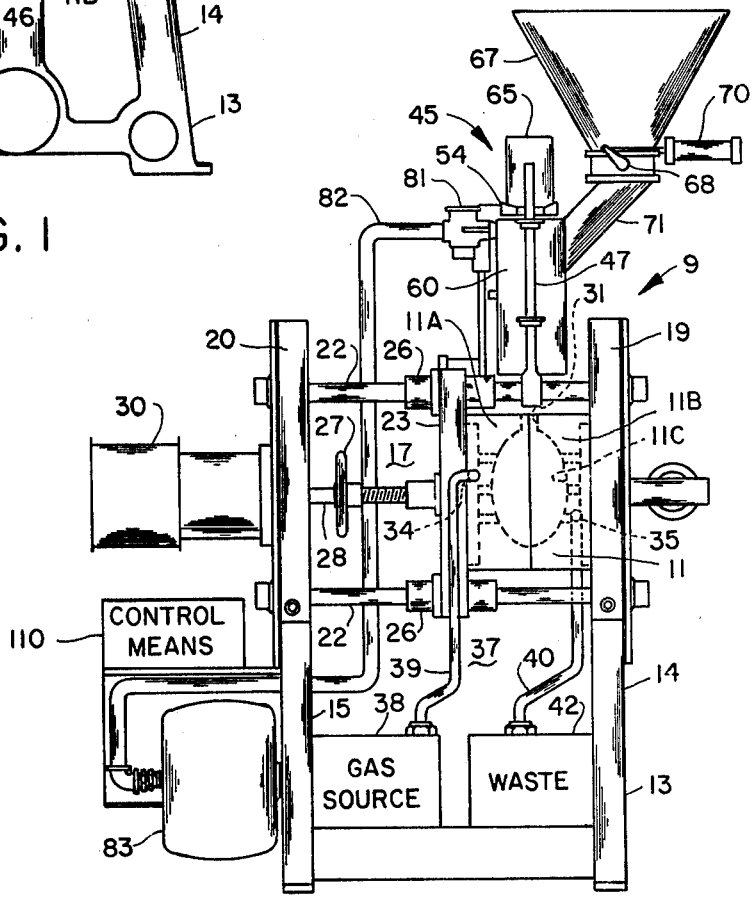
FIG. 2 is a side view of the mold forming machine illustrated in FIG. 1 with the moldbox being closed for receiving the mold material.

FIGS. 1 and 2 illustrate front and side views of a mold forming machine 9 having moldbox means 11 illustrated as open in FIG. 1 and closed in FIG. 2. The machine 9 comprises a frame 13 included upward frame members 14 and 15 journaling a moldbox mounting device 17. The moldbox mounting device 17 includes a front and a rear frame element 19 and 20 supporting a plurality of shafts 22 for movably mounting a moldbox holder 23 relative to moldbox holder 24 on bearings 26. The moldbox holder 23 is connected by an adjustment screw 27 and ram 28 to a hydraulic cylinder 30 enabling linear movement of the moldbox holder 23 on shafts 22. The moldbox holders 23 and 24 form supports for a first and a second portion 11A and 11B of the moldbox 11 which when closed define mold cavity 11C. An aperture 31 in the moldbox 11 receives the injected mold material into the mold cavity 11C.

The machine 9 heretofore described is a conventional hot mold process mold forming machine. The hot process commences with injection of the thermosetting mold material into the aperture 31 to enter the mold cavity 11C. The moldbox portions 11A and 11B are heated by heaters which have not been shown. The moldbox heaters are generally located between the moldbox 11 and the moldbox holders 23 and 24. Upon injection of the mold material into the mold cavity 11C and partial heat curing, the front and rear frame elements 19 and 20 are rotated 180 degrees orienting the aperture 31 to face downwardly. The uncured mold material from the internal portion of the mold item returns into injection means which originally injected the mold material into the cavity 11C. This movement results in a shell mold or core in the mold cavity 11C. The hydraulic cylinder 30 is then energized to retract moldbox holder 23 to the left in FIG. 2 enabling the moldbox holder 24 which is pivotably mounted by pivots 32 relative to the front frame element 19 to swing open to remove the formed mold item. The moldbox holder 24 is then closed and secured by shotpins 33. The moldbox mounting device 17 is then rotated back to the position with the aperture 31 facing upwardly to form the subsequent mold item.

Figure 3:
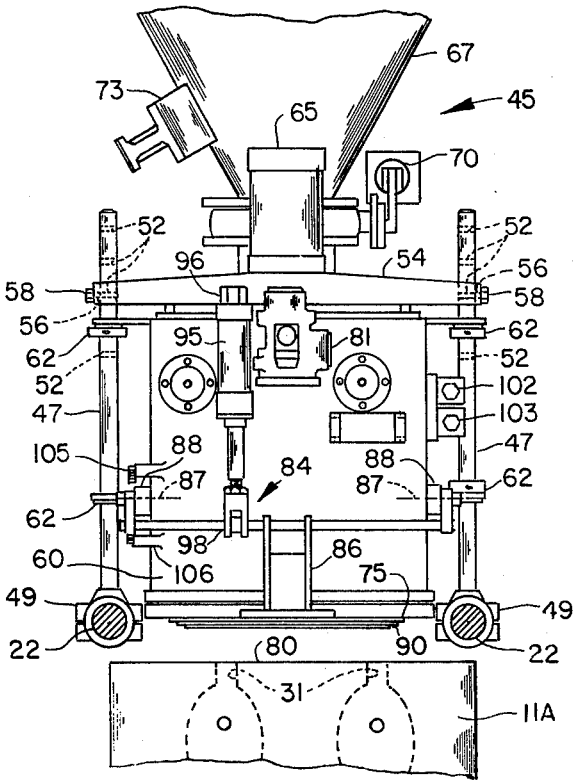
FIG. 3 is an enlarged rear view of a portion of the conversion unit shown in FIGS. 1 and 2.
Figure 4:
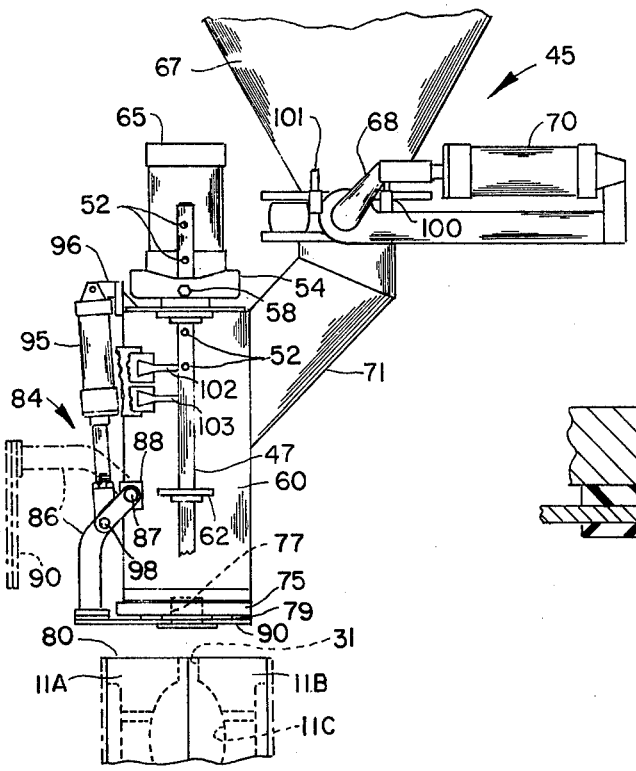
FIG. 4 is an enlarged side view of the mold conversion unit shown in FIG. 2.

The mold forming machine illustrated in FIGS. 1 and 2 has been adapted with a conversion unit 45 shown enlarged in FIGS. 3 and 4 for converting the mold forming machine from a dry mold material forming process to a moist mold material forming process. The front and rear frame elements 19 and 20 of the mold forming machine 9 have been permanently secured to the members 14 and 15 of the frame 13 by screws 46 since the journaling of the moldbox mounting device 17 is no longer required. The moldbox 11 has been modified in this embodiment to include gas ports 34 and 35. The invention includes mold material curing means 37 comprising a gas source 38 connected by a conduit 39 to gas port 34 for introducing a curing gas and a purging gas into the mold cavity 11C. The gas port 35 is connected by a conduit 40 to a waste container 42 which may recycle or dispose of the curing gas.

The gas ports 34 and 35 are in communication with the mold cavity 11C by manifolds as shown. The conversion unit 45 includes a plurality of upwardly extending members 47 each having a split ring securing device 49 for securing to the upper two shafts 22 of the mold forming machine 9. Each of the upwardly extending members 47 has a plurality of apertures 52 for mounting a conversion mounting member 54 through an aperture 56 and securing device 58 shown as screws. Selecting the proper ones of the apertures 52 in the upwardly extending members 47 enables the conversion mounting device 54 to be adjusted in accordance with the size of the moldbox 11 in the mold forming machine 9. The plurality of spaced apertures may also be contained in the conversion mounting member 54 enabling the vertical adjustment thereof relative to the moldbox 11. Mold material injection means or injection head 60 is slidably mounted to the upwardly extending members 47 by sleeves 62 secured to the mold material injection means enabling a hydraulic cylinder 65 secured to the conversion mounting member 54 to move the injection means 60 in a substantially vertical line relative to the moldbox 11. A hopper 67 is connected through a conduit 71 and a mold material valve 68 to the mold material injection means 60. The valve 68 is shown as a butterfly valve which is moved by a hydraulic cylinder 70. A vibrator 73 connected to the hopper 67 facilitates movements of the often sticky gas curable mold material from the hopper 67 into the injection means 60.

Figure 5:
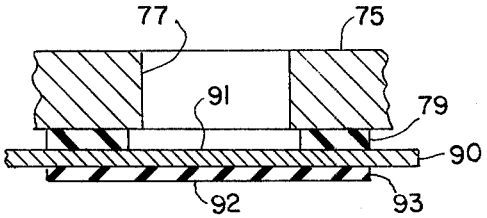
FIG. 5 is an enlarged sectional view of a portion of the unit shown in FIGS. 3 and 4.

The mold material injection head 60 includes an aperture plate 75 having injection aperture means 77 for injecting the mold material from the mold injection head 60. FIG. 5 is an enlarged sectional view through the aperture means 77. An annular resilient seal 79 such as a rubber compound is secured to the aperture plate 75 to seal with a top surface 80 of the moldbox means 11 during the injection of the mold material into the mold cavity 11C. Compressed air valve means 81 is connected by a conduit 82 to a source of compressed air 83 for injecting the mold material from the injection means 60 upon application of compressed air thereto. Aperture sealing means shown generally as 84 includes an arm 86 pivotably mounted to the injection head 60 on pivots 87 extending from mountings 88 secured to the injection head 60. The pivotable arm 86 receives an aperture sealing plate 90 having a first aperture sealing surface 91 and a second aperture sealing surface 92. In this embodiment the second aperture sealing surface 92 includes a resilient sealing member 93 secured to the underside of the aperture sealing plate 90. A hydraulic cylinder 95 is pivotably secured to the mold material injection means 60 by a support 96 and is connected at a pivot 98 of pivot arm 86 to move the aperture sealing plate 90 between the solid line and the phantom positions shown in FIG. 4.

Limit switches 100 and 101 near the mold material valve 68, limit switches 102 and 103 near the upwardly extending member 47 and limit switches 105 and 106 near the pivotable arm 86 provide signal input to control means 110 shown in FIG. 2 for controlling the operation of the machine as will be hereinafter described.

Upon activation of the control means 110, the moldbox holder 24 may be automatically or manually closed with the shotpins 33 locking the moldbox holder 24 into place. Concomitantly, therewith mold material valve 68 closes with the injection head having been furnished with sufficient mold material to inject into the mold cavity 11C. The control means 110 activates cylinder 30 moving ram 28 to the right in FIG. 2 causing engagement between the moldbox sections 11A and 11B forming the mold cavity 11C. The control means 110 activates cylinder 65 for moving the mold material injection means 60 downwardly with the seal 79 engaging the top surface 80 of the moldbox 11. Limit switch 102 ensures proper positioning of the injection means 60 relative to the moldbox 11.

The control means then activates compressed air valve 81 enabling injection of the mold material through apertures 77 and 31 to enter the mold cavity 11C. The compressed air valve 81 and limit switches 100 and 101 of the mold material valve 68 are connected to the control means 110 enabling only one of the valves to be opened at any given time. If both the air control valve and the mold material control valve were opened the blast of air would not only eject mold material from apertures 77 but also force the mold material back into hopper 67. Accordingly, such an interlock is contained in the control means 110.

After the mold material is injected into the mold cavity 11C, the control means activates cylinder 65 to raise the injection means 60 as shown and thereafter activates cylinder 95 to move the aperture sealing plate 90 from the phantom position to the solid line position as shown in FIGS. 3 and 4 thereby sealing apertures 77 of the injection means 60. The control means thereafter activates cylinder 65 to advance the injection head 60 downwardly toward the moldbox 11 enabling the second surface 92 and in particular the seal 93 of the aperture sealing plate 90 to cover aperture 31 of the moldbox thereby sealing apertures 31. The control means 110 may be programmed to open valve 68 at this point in the process thereby filling the injection means 60 with mold material for the next mold item. The control means then activates the gas source 38 enabling curing gas to enter gas port 34 by conduit 39 to cure the mold material in the mold cavity 11C to form the mold item. Subsequently, the curing gas is purged from the cavity 11C to exit by port 35 and conduit 40 into a waste container 42 which may recycle the curing gas back to the gas source 38 or may otherwise dispose of the curing gas. The control means reactivates cylinder 65 to withdraw the injection means 60 from the upper surface 80 of the moldbox 11 and subsequently activates cylinder 95 to rotate the aperture sealing plate 90 into the phantom position. Activation of cylinder 30 by the control means 110 retracts the moldbox holder 23 enabling the control to open shotpins 33 in the moldbox holder 24 to open the door on pivots 32. The control means may activate ejection of the mold item from the moldbox or may be manually ejected by an operator as well known to the art.

The mold forming machine 9 as originally disclosed includes a rotatable front and rear frame element 19 and 20 enabling orientation of the aperture 31 of the moldbox means 11 in either a downwardly or an upwardly facing direction. The mold material injection means 60 was filled with dry mold material when the injection means 60 was located below the moldbox means 11. Accordingly, the last mold material portion into the mold material injection means 60 was the first mold material portion injected out of the mold material injection means 60.

The last in first out mold material process was unsuitable for moist mold material since the moist mold material began to cure within the injection means 60. Accordingly, a first in first out mold material process is required for use with the more difficult moist mold material. The disclosed conversion unit 45 converts the mold forming machine 9 which was designed for a dry mold material into a machine suitable for injecting a moist mold material. The injection means 60 and the hopper 67 are positioned above the moldbox means 11 to convert the machine 9 from a last in first out mold process to a first in first out mold process. The first mold material portion from hopper 67 into the injection means 60 is the first mold material portion injected out of the injection means 60 into the mold cavity 11C.

Although the invention has been disclosed as a conversion unit for converting a mold forming machine from a dry mold material mold forming process to a moist mold material mold forming process from which mold items may be formed from a gas or heat curable mold material, it is understood that the invention may be incorporated in a machine which is specifically built for a moist mold material mold forming process. It is also understood that the instant invention is not limited to a gas or heat curable mold material but to any similiar mold material for forming a mold item.

I claim:

1. A conversion unit for converting a mold forming machine from a dry mold material mold forming process to a moist mold material mold forming process by which a mold item may be formed from an initially moist curable mold material, the mold forming machine having moldbox means rotatable between first and second stations and defining a mold cavity with first aperture means in the moldbox means in communication with the mold cavity, comprising in combination:

means provided to prevent rotation of the moldbox means so that the machine is operable at one of the two stations;

mold material injection means connected for injecting mold material of a composition including sand or other similar particulate material from second aperture means;

aperture sealing means rotatably mounted on one of the moldbox means and said mold material injection means;

first movement means connected to said mold material injection means and the moldbox means of the mold forming machine to cause relative movement therebetween;

second movement means connected to rotate said aperture sealing means to a position interposed between the moldbox means and said injection means;

control means;

means connecting said control means to said first movement means to cause actuation thereof to establish said mold material injection means to be adjacent the moldbox means enabling injection of the mold material through the first aperture means into the mold cavity;

means connecting said control means to said second movement means and operable after injection of the mold material into the mold cavity to rotate said aperture sealing means to a position interposed between the moldbox means and said injection means for sealing the first aperture means;

mold material curing means;

means connecting said mold material curing means to the moldbox of the mold forming machine;

and means connecting said control means to said mold material curing means to actuate same enabling cure of the mold material to form the mold item.

2. A conversion unit as set forth in claim 1, including adjustable conversion unit support means adjustably mounting said mold material injection means and said aperture sealing means relative to the mold forming machine in accordance with the size of the moldbox means of the mold forming machine.

3. A conversion unit as set forth in claim 1, including an annular seal about said second aperture means in said mold material injection means.

4. A conversion unit as set forth in claim 1, wherein said first and second movement means include hydraulic cylinder means.

5. A conversion unit as set forth in claim 1, wherein said mold material injection means includes an injection head having a compressed air input and a mold material input;

compressed air valve means connecting said compressed air input of said injection head to a source of compressed air;

mold material valve means connecting said mold material input of said injection head to a source of mold material;

and means connecting said control means to said compressed air valve and said mold material valve to enable only one of said valve means to be open at any given time.

6. A conversion unit as set forth in claim 5, wherein said source of mold material includes a hopper;

and vibrating means mounted relative to said hopper for facilitating the flow of the mold material from said hopper to said injection head.

7. A conversion unit as set forth in claim 1, wherein said mold material injection means includes an injection head having said second aperture means located on one side of said injection head;

said aperture sealing means including a pivotable arm and an aperture sealing plate thereon with said pivotable arm being rotatably mounted to another side of said injection head enabling said sealing plate to cover said second aperture means on said one side of said injection head.

8. A conversion unit as set forth in claim 1, wherein said aperture sealing means includes an aperture sealing plate having a first and a second sealing plate surface;

said second movement means connected to rotate said sealing plate to cover second aperture means of said mold material injection means with said second sealing plate surface of said aperture sealing plate;

and said first movement means connected to rotate said sealing plate to cover the first aperture means of the moldbox means with said first sealing plate surface of said aperture sealing plate.

9. A conversion unit as set forth in claim 1, including a conversion unit support means having a plurality of upwardly extending members mounted to the mold forming machine;

said upwardly extending members having a plurality of apertures;

a conversion mounting member having a plurality of apertures slidably mounted to said plurality of upwardly extending members;

means mounting the conversion unit on said conversion mounting member;

and a plurality of securing members extending through selected ones of said plurality of apertures of said conversion mounting member and said upwardly extending members to adjust the position of said mold material injection means in accordance with the size of the moldbox means of the mold forming machine.

10. A conversion unit as set forth in claim 1, including means for mounting said mold material injection means at a level above the moldbox means for downward flow of the mold material to be aided by gravity.

* * * * *